US005163768A

United States Patent [19]

Salisbury et al.

[11] Patent Number: 5,163,768

[45] Date of Patent: Nov. 17, 1992

[54] COMBINED BINDER AND SUSPENDED FILE ASSEMBLY

[75] Inventors: Thomas E. Salisbury, Wayland, Mass.; Robert C. Amrich, Glastonbury, Conn.; Vytautas K. Beleckis, E. Long Meadow, Mass.

[73] Assignee: Avery Dennison Corporation, Pasadena, Calif.

[21] Appl. No.: 817,882

[22] Filed: Jan. 7, 1992

[51] Int. Cl.[5] ..... B42F 15/04; B42F 21/00

[52] U.S. Cl. ..... 402/3; 402/4; 402/80 P

[58] Field of Search ..... 402/4, 3, 80 R, 80 P

[56] References Cited

U.S. PATENT DOCUMENTS

| | | | |
|---|---|---|---|
| 3,196,564 | 7/1965 | Boedeker | 402/3 X |
| 3,801,175 | 4/1974 | Giulie | 312/184 |
| 3,865,445 | 2/1975 | Dean et al. | 312/184 |
| 3,980,360 | 9/1976 | Wright et al. | 312/184 |
| 4,056,296 | 11/1977 | Hedstrom et al. | 312/184 |
| 4,171,854 | 10/1979 | Hedstrom et al. | 312/184 |
| 4,306,736 | 12/1981 | Cournover et al. | 281/15 |
| 4,445,799 | 5/1984 | Wright et al. | 402/4 |
| 4,679,955 | 7/1987 | Marsh | 402/4 |

FOREIGN PATENT DOCUMENTS

| | | | |
|---|---|---|---|
| 680215 | 8/1939 | Fed. Rep. of Germany | 402/3 |
| 2441171 | 3/1976 | Fed. Rep. of Germany | 402/4 |
| 226604 | 3/1969 | Sweden | 402/3 |

*Primary Examiner*—Paul A. Bell

*Attorney, Agent, or Firm*—Poms, Smith, Lande & Rose

[57] ABSTRACT

A combined binder and suspended file assembly has an elongated spine defining an elongated triangular channel with two substantially planar elongated members integrally formed in a hinged relationship to the edges of the channel. The binder and file assembly further includes pins and mating securing recesses wherein the pins are integrally formed on one of the elongated planar members, and the recesses are formed in the opposite planar member, such that the pins are inserted through holes in the sheets of paper to bind the paper. The binder and file assembly is suspended from a two rail suspension filing system by two retractable hooks, each of the hooks slidably engaged to one of the ends of the spine member and further wherein the hooks and spine member include interfitting recesses and ridges so as to enable the hooks to lock in a retracted position and in an extended position. The binder and file assembly also includes a recess on the outer surface of the spine for receiving a label, which is angled in a direction for easy viewing when the assembly is stored in a suspended filing system.

20 Claims, 3 Drawing Sheets

COMBINED BINDER AND SUSPENDED FILE ASSEMBLY

FIELD OF INVENTION

This invention relates to document holders and more particularly to binders for looseleaf materials designed for binding and filing documents in two rail suspension filing systems.

BACKGROUND OF INVENTION

Suspension or vertical filing systems designed for use with suspension filing systems are known in the art. For example, U.S. Pat. No. 4,306,736 issued to Cournover et al. on Dec. 22, 1981 discloses a document holder for use with a single rail suspension filing system. Other types of document binders for use with either one rail or two rail suspension filing systems are also known in the art. For example, U.S. Pat. No. 4,171,854 issued to Hedstrom et al. on Oct. 23, 1979; U.S. Pat. No. 4,056,296 issued to Hedstrom et al. on Nov. 1, 1977; and U.S. Pat. No. 3,980,360 issued to Wright et al. on Sep. 14, 1976 each disclose document binders for use with either single rail or double rail suspension filing systems. More specifically, each of these binders includes a document holding channel with two non-retractable hooks extending beyond the ends of the channel to suspend the binder from a two rail suspension system. The channel portion of each of these prior art binders further defines another hook section for suspending the document binder from a single rail suspension filing system.

One problem with the document holders having two hooks extending beyond the ends of the binder for use with the double rail suspension filing system is that the hooks interfere with the storage of the documents when the documents in the binders are stored in a box or shelved as a conventional book. To solve this problem, document binders for use with two rail suspension filing systems were designed with retractable hooks, such that the hooks could be retracted in order to store or shelve the binder with the documents bound within the binder. U.S. Pat. No. 4,445,799 issued to Wright et al. on May 1, 1984; U.S. Pat. No. 3,865,445 issued to Dean et al. on Feb. 11, 1975; and U.S. Pat. No. 3,801,175 issued to Giulie on Apr. 2, 1974 each discloses a document binder with retractable hooks for use on a two rail suspension filing system.

However, these document binders of the prior art used with two rail suspension filing systems have substantially planar, relatively thin hooks. As a result, the hooks are prone to breakage when the binders are carelessly inserted into the two rail suspension filing system, or when the hooks are forced into an extended or retracted position. Therefore, a need exists for a document binder for use with a two rail suspension filing system having retractable hooks of increased strength.

Another problem with the prior art binders used with two rail suspension filing systems is that either the binder does not have a planar area to place a label, or else the only location for placing a label is in a position difficult to see once the binder is filed in the two rail suspension filing system. Therefore, a need also exists for a document binder for use with a two rail suspension filing system with a label mounting area located for convenient visibility when the binder is filed in a file drawer.

Still another problem with the prior art is that the cross-sectional area of the spine portion of the binders tends to be relatively thin. As a result, the binders are not as durable as desired. Therefore, a need exists for a document binder for use with a two rail suspension filing system wherein the cross-sectional area of the binder provides increased strength and support for the bound documents.

SUMMARY OF INVENTION

One object of the present invention is to provide a combined binder and suspended file assembly with increased strength.

Another object of the present invention is to provide a combined binder and suspended file assembly having hooks with increased strength.

A still further object of the invention is to provide a combined binder and file assembly with increased support for the bound documents.

Yet another object of this invention is to provide a combined binder and file assembly with a designated area for mounting labels that is easily visible when the binder is filed in the suspension filing system.

These and other objects of the present invention are achieved through a combined binder and suspended file assembly comprising an elongated spine member defining an elongated triangular channel, the channel having a first edge and a second edge adjacent the channel opening, a first and a second substantially planar elongated member, each planar member integrally formed in a hinged relationship to one of the first and second edges of the channel; a plurality of pins and mating securing recesses wherein the pins are integrally formed on one of the elongated planar members, and the recesses are formed in the opposite planar member, such that the pins are inserted through holes in the sheets to bind the sheets; and two retractable hooks, each of the hooks slidably engaged to one of the ends of the spine member and further wherein the hooks and spine member include interfitting recesses and ridges so as to enable the hooks to lock in a retracted position and in an extended position. The spine member further includes a recess on the outer surface thereof for receiving a label, which will be angled in one direction for easy viewing when the assembly is stored in a suspended filing system.

It is noted in passing that the use of a triangular cross-sectional configuration for the spine and the supporting hooks has the advantages both of providing increased mechanical strength for the spine and hooks, and also of providing a slanted surface for label locations so that hanging files may be easily identified and located.

In accordance with another aspect of the invention, the combined binder and suspended file assembly comprises an elongated spine member defining an elongated triangular channel, the channel having a first edge and a second edge adjacent the channel opening, the spine member further having a first end and a second end; a first and a second substantially planar member, each planar member integrally formed in a hinged relationship to the corresponding first and second edge of said channel; means for securing a plurality of sheets of paper between the planar members; and two retractable hooks slidably engaged to the first and second end of the spine member wherein the hooks and spine member include interfitting recesses and ridges so as to enable the hooks to lock in a retracted position and in an extended position.

In accordance with a further aspect of the invention, the combined binder and suspended file assembly comprises an elongated spine member having two elongated planar members hingedly extending from the elongated edges of the spine member, wherein each of the elongated planar members is integrally formed on one of the edges, and further wherein, when suspended from a suspended filing system, the angle between one of the planar members and the spine member is a substantially acute angle; means for securing a plurality of sheets of paper between the elongated planar members; and two retractable hooks, each of the hooks slidably engaged with one of the ends of the elongated spine member, and wherein each of the hooks has a generally triangular cross-sectional configuration.

These and other objects of the present invention will now become apparent from a review of the drawings and the following description of the preferred embodiments.

DETAILED DESCRIPTION OF THE PREFERRED EMBODIMENT

Figure 1:
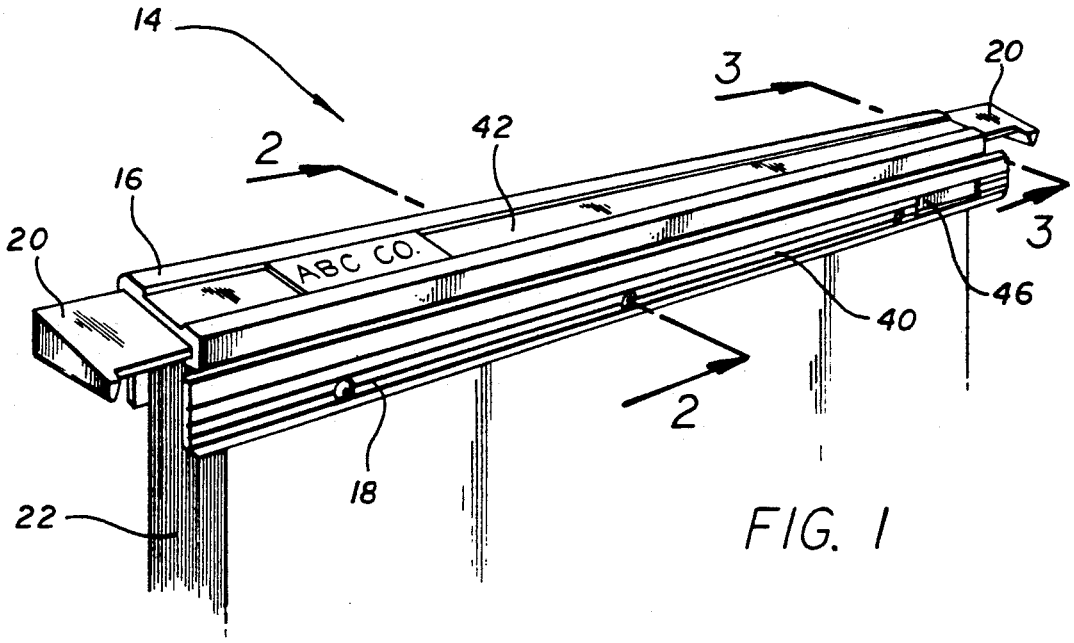
FIG. 1 is a perspective view of the preferred embodiment of the combined binder and suspended file assembly of this invention, with paper in the binder.

Referring now to FIG. 1, a preferred embodiment of a combined binder and suspended file assembly 14 is shown. The combined binder and suspended file assembly 14 is primarily comprised of an elongated spine member 16, two substantially planar elongated members 18, and two retractable hooks 20. The retractable hooks 20 are shown in their extended position in FIG. 1.

Figure 2:
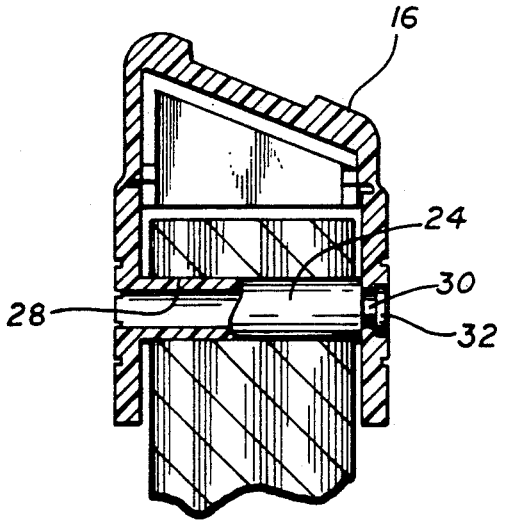
FIG. 2 is a cross-sectional side view of the combined binder and suspended file assembly of FIG. 1 taken along Line 2—2 of FIG. 1.

Referring now to both FIGS. 1 and 2, a plurality of documents or other sheet-like items 22 are held in place between the planar elongated members 18 by a plurality of pins 24 integrally formed on one of the elongated planar members 18, and a plurality of mating securing recesses 26 formed in the opposite planar member 18. In order to bind the documents 22, the pins 24 are inserted through a plurality of holes 28 punched in the documents 22, and the pins 24 are secured into the corresponding securing recesses 26. As shown in FIGS. 1 and 2, when the documents 22 are bound in the combined binder and suspended file assembly 14, the planar elongated members 18 are in a substantially planar relationship to each other.

In the preferred embodiment of the combined binder and suspended file assembly 14, three pins 24 and three corresponding recesses 26 are used in order to accommodate a standard three-hole punched document. However, various number of pins 24 and recesses 26 can be used to accommodate various types of documents or sheet-like items.

In the preferred embodiment, the pins 24 are substantially circular in cross-section, with each pin 24 having a circumferential groove 30 formed at an outer end 32 of the pin 24. The groove 30 serves to enhance the interlocking feature of the pin 24 and the securing recess 26.

Figure 3:
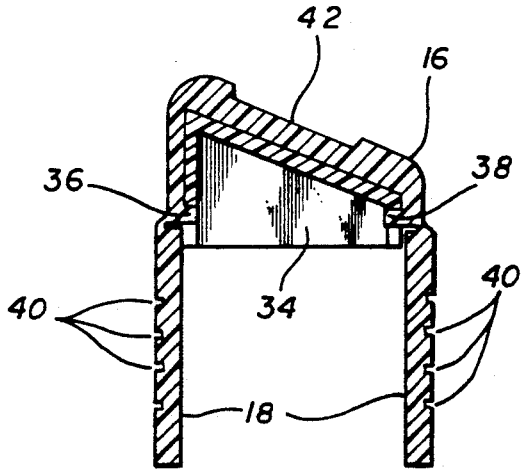
FIG. 3 is a cross-sectional side view of the combined binder and suspended file assembly of FIG. 1 taken along Line 3—3 of FIG. 1.
Figure 4:
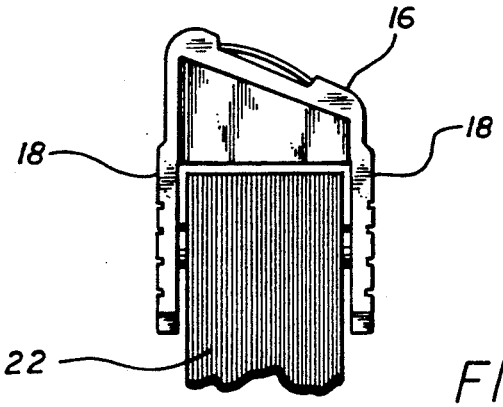
FIG. 4 is an end view of the combined binder and suspended file assembly of FIG. 1.

Referring now to FIGS. 3 and 4, the construction of the spine member 16 and the planar elongated members 18 of the combined binder and suspended file assembly 14 is shown in detail. The spine member 16 defines an elongated channel 34. The channel 34 has a generally open triangular cross-sectional configuration, with one side of the triangle being open. The triangular cross-sectional configuration of the spine member 16 increases the strength and support of both the spine member 16 and the combined binder and suspended file assembly 14. One of the planar elongated members 18 extends from a first edge 36 of the open end of the channel 34, and the other one of the planar elongated members 18 extends from a second edge 38 of the open end of the channel 34. The planar elongated members 18 extend from the spine member 16 such that when suspended from a suspended filing system, the angle between one of the planar elongated members 18 and the spine member 16 is a substantial acute angle, preferably between about 10 and about 45 degrees. The planar elongated members 18 are hingedly secured to the edges 36 and 38 in order to allow easy insertion and removal of the documents 22 between the planar elongated members 18.

As best shown in FIGS. 1 and 3, the planar elongated members 18 include a plurality of longitudinally extending ridges 40 on the outer surface of the members 18. The ridges 40 provide a gripping surface for ease in removal and insertion of the combined binder and suspended file assembly 14 into a suspended filing system.

Referring to FIGS. 1, 3, and 4, the spine member 16 in the preferred embodiment includes a first recess 42 on the outer surface of the spine member 16. The first recess 42 is provided for the placement of a label 44 on the combined binder and suspended file assembly 14. The angled location of the first recess 42 enables users to easily read the label 44 when the combined binder and suspended file assembly 14 is filed in a two rail suspension filing system. As seen in FIG. 1, in the preferred embodiment, one of the planar elongated members 18 includes a second recess 46 on the outer surface of the member 18 for placement of a second label (second label not shown).

Figures 5, 6, 7, 8, 9:
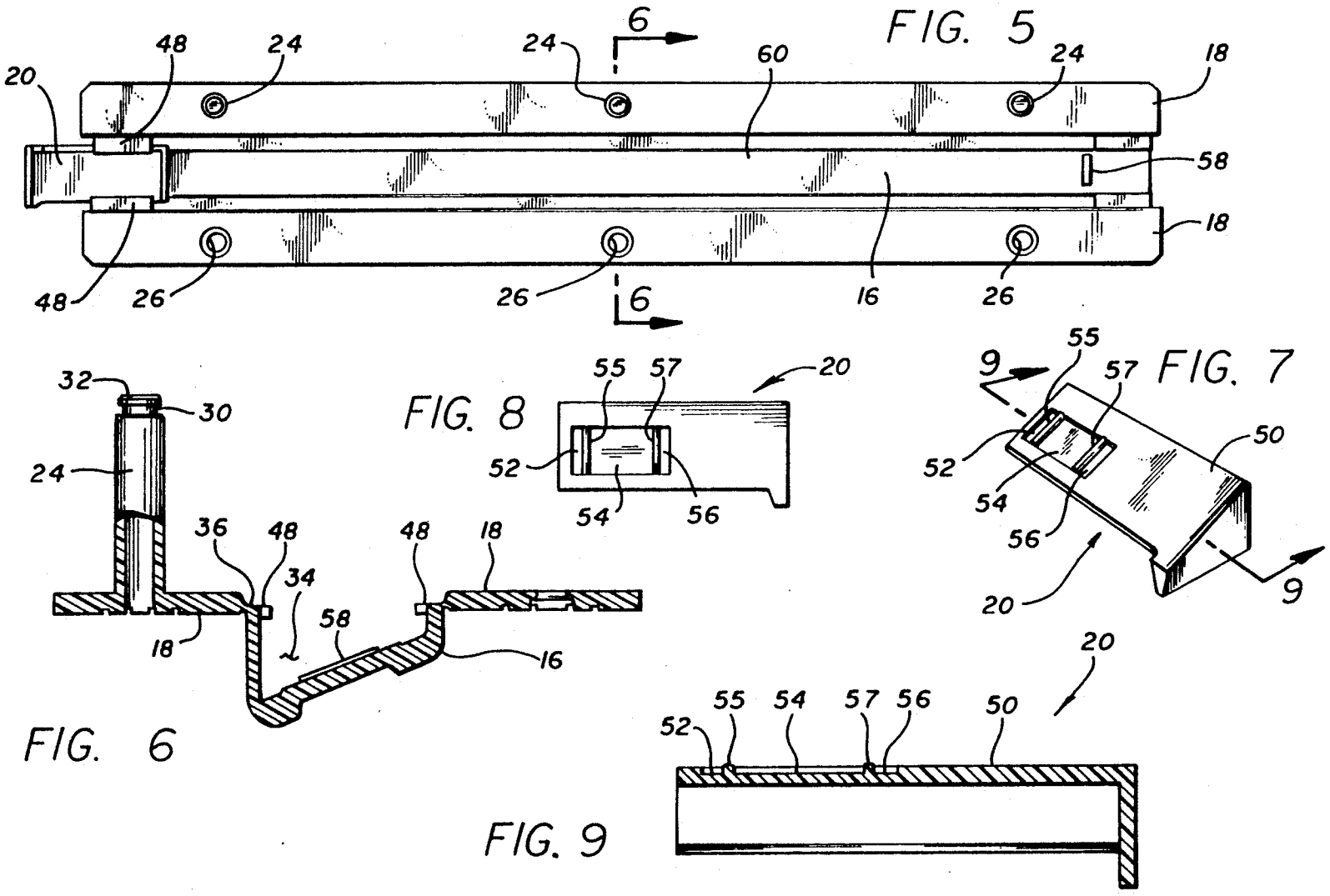
FIG. 5 is a bottom view of the combined binder and suspended file assembly in an opened position.
FIG. 6 is side cross-sectional view of the combined binder and suspended file assembly taken along Line 6—6 of FIG. 5.
FIG. 7 is a perspective view of the preferred embodiment of the retractable hook of the combined binder and suspended file assembly.
FIG. 8 is a top view of the retractable hook of FIG. 7.
FIG. 9 is a cross-sectional front view of the retractable hook of FIG. 7 taken along Line 9—9 of FIG. 7.
Figure 10:
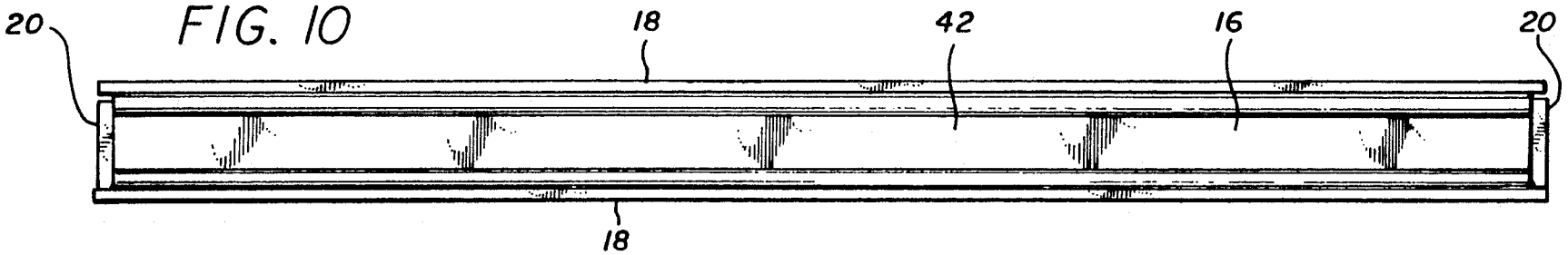
FIG. 10 is a top plan view of the combined binder and suspended file assembly.
Figure 11:
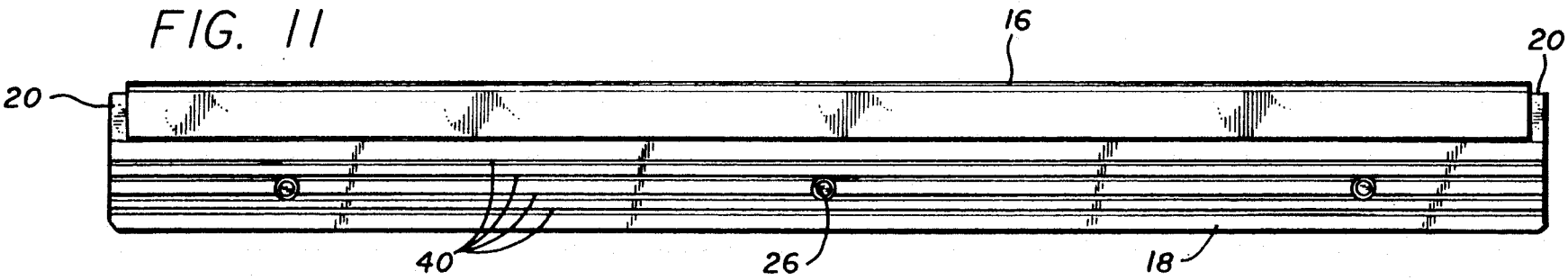
FIG. 11 is a rear elevational view of the combined binder and suspended file assembly.
Figure 12:
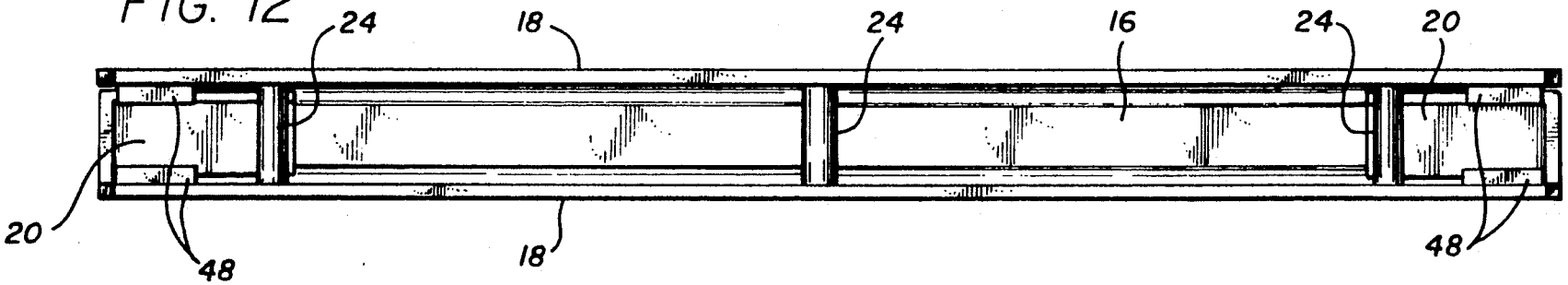
FIG. 12 is a bottom plan view of the combined binder and suspended file assembly.

Referring now to FIGS. 5 and 6, it is shown that the spine member 16, the planar elongated members 18, and the pins 24 are preferably integrally formed from a flexible plastic material. Specifically, the binding is molded in the configuration shown in FIGS. 5 and 6, and thus may be formed inexpensively in a single molding operation, including, for example the pins 24, and the reduced thickness hinges which connect the spine 16 with the elongated side members 18. The flexible plastic material enables the combined binder and suspended file assembly 14 to be easily opened and closed for the insertion and removal of documents 22. Moreover, the flexible plastic material used for the combined binder and suspended file assembly 14 is durable, yet lightweight.

The spine member 16 is further shown in FIG. 6 to include two inwardly extending ribs 48. The ribs 48 extend along a portion of the edges 36 and 38 of the channel 34 near the ends of the spine member 16. The ribs 48 support the retractable hooks 20 within the spine member 16, and allow the retractable hooks 20 to slide in and out of the spine member 16, supported by the ribs 48.

Referring now to FIGS. 7, 8 and 9, the retractable hooks 20 of the combined binder and suspended file assembly 14 are shown in detail. As shown in FIG. 7, the retractable hooks 20 have a generally open triangular cross-sectional configuration, which corresponds to the cross-sectional configuration of the spine member 16. The triangular cross-sectional configuration also provides increased strength for the hook 20 and reduces the likelihood of breakage of the hook 20.

Referring to FIGS. 7 and 8, the retractable hooks 20 have an upper surface 50. The upper surface 50 includes an extended position recess 52, a sliding position recess 54, and a retracted position recess 56. The recesses 52, 54, and 56 are dimensioned to interfit with one of two locking ridges 58 (shown in FIG. 5) located in close proximity to the ends the spine member 16 on an underside 60 of the spine member 16. When the retractable hook 20 is first slidably engaged with the spine member 16, the ridge 58 interlocks with the extended position recess 52. When the user chooses to retract the hook 20 into the spine member 16, the hook 20 is slid along within the retaining ribs 48, and a detaining ridge 55 is forced over the ridge 58, and then the ridge 58 is freely accepted within the sliding position recess 54. The hook 20 is pushed inward toward the center of the spine member 16 until the ridge 57 is forced over the rib 58, and the rib 58 is in the retracted position recess 56. The hook 20 is then secured in a fully retracted position. With the structure as described in this paragraph being entirely molded into the parts as they are formed, a simple yet effective detenting arrangement is achieved.

Having thus described exemplary embodiments of the present invention, it should be noted by those skilled in the art that the within disclosures are exemplary only and that various other alternatives, adaptations and modifications may be made within the scope of the invention. Thus by way of example, but not of limitation, oppositely directed pairs of pins or curved paper securing members with latching engagement may be used instead of the single pins 24 and securing recesses 26 for binding the documents 22 between the planar elongated members 18. As another alternative, the planar elongated members 18 may be dimensioned so as to more completely or to fully cover the bound documents, for example, the planar elongated members 18 may be of greater rectangular extent to cover standard paper sheets. Accordingly, it is to be understood that the present invention is not limited to the precise construction as shown in the drawings and described hereinabove.

We claim:

1. A combined binder and suspended file assembly comprising:

an elongated spine member having a generally open triangular configuration and having a first and a second elongated edge, and a first and a second end, said spine member having two elongated planar members hingedly extending from the elongated edges, wherein each of said elongated planar members is integrally formed on one of the edges, and further wherein, when suspended from a suspended filing system, the angle between one of the planar members and the spine member is a substantial acute angle;

means for securing a plurality of sheets of paper between said elongated planar members; and two retractable hooks, each of said hooks slidably engaged with one of said ends of said elongated spine member, and wherein each of said hooks has a generally open triangular cross-sectional configuration.

2. A combined binder and suspended file assembly in accordance with claim 1 wherein said hooks further include interfitting recesses and ridges so as to enable the hooks to lock in a retracted position and in an extended position.

3. A combined binder and suspended file assembly in accordance with claim 1 wherein said spine member has an inwardly protruding ridge at each end and wherein each of said hooks has a central longitudinally extending recess for receiving said ridge and permitting longitudinal extension movement of said hooks with said ridge in said central recess, and short recesses at each side of said central recess for detenting each of said hooks in the retracted and in the extended configurations.

4. A combined binder and suspended file assembly in accordance with claim 1 wherein said spine includes a first recess for mounting a label, and further wherein the first recess is located at an angle for easy visibility of the label when the binder is in a suspended position.

5. A combined binder and suspended file assembly as defined in claim 1 wherein one of said elongated planar members has a second recess on the outer surface thereof for receiving a label.

6. A combined binder and suspended file assembly in accordance with claim 1 wherein said securing means is comprised of a plurality of pins and mating securing recesses wherein said pins are integrally formed on one of said elongated planar members, and said recesses are formed in the opposite planar member, such that the pins are inserted through holes in the sheets.

7. A combined binder and suspended file assembly as defined in claim 6 wherein said spine member, said elongated planar members, and said pins are integrally molded together from plastic material.

8. A combined binder and suspended file assembly comprising:

a longitudinally extending binder member having a generally open triangular configuration with one side open and first and second edges adjacent the open side of said binder member;

first and second longitudinally extending flat members formed integrally with said binder member and hingedly secured to said first and second edges, respectively, said flat members including pins and mating securing recesses for securing hole-punched sheets of paper into said assembly by said pins extending through holes in the sheets of the papers; and two slider hooks, one mounted retractably at each end of said binder member for selective extension from said binder member to support said assembly in a suspension-type file drawer, said slider hooks and said binder member having interfitting recesses and detents for holding said slider hooks in the extended or retracted positions.

9. A combined binder and suspended file assembly as defined in claim 8 wherein said binder member has a first recess on the outer surface thereof for receiving a label, which will be angled in one direction for easy viewing when the assembly is stored in a suspended file configuration.

10. A combined binder and suspended file assembly as defined in claim 8 wherein one of said flat members has a second recess on the outer surface thereof for receiving a label.

11. A combined binder and suspended file assembly as defined in claim 8 wherein said binder member, said two flat members, and said pins are integrally molded together from plastic material.

12. A combined binder and suspended file assembly in accordance with claim 8 wherein said binder member has an inwardly protruding ridge at each end and wherein each of said slider hooks has a central longitudinally extending recess for receiving said ridge and permitting longitudinal extension movement of said slider hook with said ridge in said central recess, and short recesses at each side of said central recess for detenting each of said slider hooks in the closed and in the extended configurations.

13. A combined binder and suspended file assembly in accordance with claim 8 wherein said sliding hooks have a generally open triangular cross-sectional configuration.

14. A combined binder and suspended file assembly comprising:

an elongated spine member defining an elongated triangular channel, said channel having a first edge and a second edge adjacent the channel opening, said spine member further having a first end and a second end;

a first and a second substantially planar member, each planar member integrally formed in a hinged relationship to the corresponding first and second edge of said channel;

means for securing a plurality of sheets of paper between said planar members; and a first and a second retractable hook, each of said hooks slidably engaged to the corresponding first and second end of said spine member and further wherein the hooks and spine member include interfitting recesses and ridges so as to enable the hooks to lock in a retracted position and in an extended position.

15. A combined binder and suspended file assembly in accordance with claim 14 wherein said securing means is comprised of a plurality of pins and mating securing recesses wherein said pins are integrally formed on one of said elongated planar members, and said recesses are formed in the opposite planar member, such that the pins are inserted through holes in the sheets.

16. A combined binder and suspended file assembly as defined in claim 15 wherein said spine member, said planar members, and said pins are integrally molded together from a flexible plastic material.

17. A combined binder and suspended file assembly as defined in claim 14 wherein said spine member has a first recess on the outer surface thereof for receiving a label, and further wherein the first recess is angled in a direction for easy viewing when the assembly is stored in a suspended file assembly.

18. A combined binder and suspended file assembly as defined in claim 14 wherein one of said planar members has a second recess on the outer surface thereof for receiving a label.

19. A combined binder and suspended file assembly in accordance with claim 14 wherein said hooks have a generally open triangular cross-sectional configuration.

20. A combined binder and suspended file assembly in accordance with claim 14 wherein said spine member has an inwardly protruding ridge at each end and wherein each of said hooks has a central longitudinally extending recess for receiving said ridge and permitting longitudinal extension movement of said hooks with said ridge in said central recess, and short recesses at each side of said central recess for detenting each of said hooks in the retracted and in the extended configurations.

* * * * *